US010670993B2

(12) United States Patent
Kato et al.

(10) Patent No.: US 10,670,993 B2
(45) Date of Patent: Jun. 2, 2020

(54) DEVELOPING DEVICE

(71) Applicant: FUJI XEROX CO., LTD., Tokyo (JP)

(72) Inventors: Nao Kato, Kanagawa (JP); Masayuki Shimoda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/282,303

(22) Filed: Feb. 22, 2019

(65) Prior Publication Data

US 2020/0096908 A1 Mar. 26, 2020

(30) Foreign Application Priority Data

Sep. 25, 2018 (JP) ..... 2018-178252

(51) Int. Cl.
*G03G 15/08* (2006.01)

(52) U.S. Cl.
CPC ..... *G03G 15/0891* (2013.01)

(58) Field of Classification Search
None
See application file for complete search history.

(56) References Cited

U.S. PATENT DOCUMENTS 5,012,286 A * 4/1991 Kawano ..... G03G 15/0896 399/59
7,269,381 B2 9/2007 Okuda et al.

FOREIGN PATENT DOCUMENTS

JP 2005352225 12/2005
JP 2009080358 4/2009

* cited by examiner

*Primary Examiner* — Victor Verbitsky
(74) *Attorney, Agent, or Firm* — JCIPRNET

(57) ABSTRACT

A developing device includes a first developer transport path, called as first path hereinafter; a first transport screw that transports a developer in the first path; a first conveyance roller that is thicker than a shaft of the first transport screw, attracts by magnetic force the developer at a downstream end portion of a second developer transport path arranged next to the first path, and conveys the developer to an upper portion located upstream of the first path; a first scraping wall that scrapes and sends the attracted developer; and a first guide columnar body that is adjacent to the first conveyance roller, has a peripheral surface continuous to the first conveyance roller, receives, using the peripheral surface, and guides the sent developer to an upstream end portion of the first path, and has a length that the guided developer is not attracted by the magnetic force.

18 Claims, 4 Drawing Sheets

DEVELOPING DEVICE

CROSS-REFERENCE TO RELATED APPLICATION

This application is based on and claims priority under 35 USC 119 from Japanese Patent Application No. 2018-178252 filed Sep. 25, 2018.

BACKGROUND

(i) Technical Field

The present disclosure relates to a developing device.

(ii) Related Art

As a developing device that is used for an electrophotographic image forming apparatus, there is known a developing device in which two developer transport paths are arranged in parallel to each other to form a circulation path, and a developer is transported in a circulating manner, stirred, and charged with electricity.

Japanese Unexamined Patent Application Publication Nos. 2009-80358 and 2005-352225 disclose a circulation transport path in which screws are arranged in parallel developer transport paths to extend along the transport paths. When the screws rotate, a developer is transported along the transport paths. A magnetic roller is arranged adjacently to an upstream end portion of one of the transport paths. The magnetic roller rotates together with the corresponding screw and includes a magnet. With the magnetic roller, the developer is conveyed from a downstream end portion of the other one of the transport paths to the upstream end portion of the transport path to which the magnetic roller belongs.

SUMMARY

In the developing device including the magnetic roller that is located adjacently to the upstream end portion of the one transport path and that conveys the developer from the other transport path by magnetic force, the developer located upstream of the one transport path may be attracted by the magnetic force of the magnetic roller and hence may be retained. When the developer is retained by a certain amount, a batch of the retained developer starts flowing. If a batch of the developer is retained and then flows repetitively, the transport amount of the developer varies and hence is not stable.

Aspects of non-limiting embodiments of the present disclosure relate to eliminating retention of a developer that occurs upstream of a transport path by magnetic force of a magnetic roller.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including a first developer transport path; a first transport screw that transports a developer in the first developer transport path; a first conveyance roller that has a larger radius than a radius of a shaft of the first transport screw, that attracts by magnetic force the developer at a downstream end portion of a second developer transport path arranged next to the first developer transport path, and that conveys the developer to an upper portion located upstream of the first developer transport path; a first scraping wall that scrapes the developer attracted to the first conveyance roller and that sends the developer; and a first guide columnar body that is adjacent to the first conveyance roller, that has a peripheral surface continuous to a peripheral surface of the first conveyance roller, that receives, using the peripheral surface thereof, the developer sent by the first scraping wall, that guides the developer to an upstream end portion of the first developer transport path, and that has a length that the developer located at the upstream end portion of the first developer transport path is not attracted by the magnetic force of the first conveyance roller.

BRIEF DESCRIPTION OF THE DRAWINGS

Exemplary embodiments of the present disclosure will be described in detail based on the following figures, wherein.

DETAILED DESCRIPTION

Figure 1:
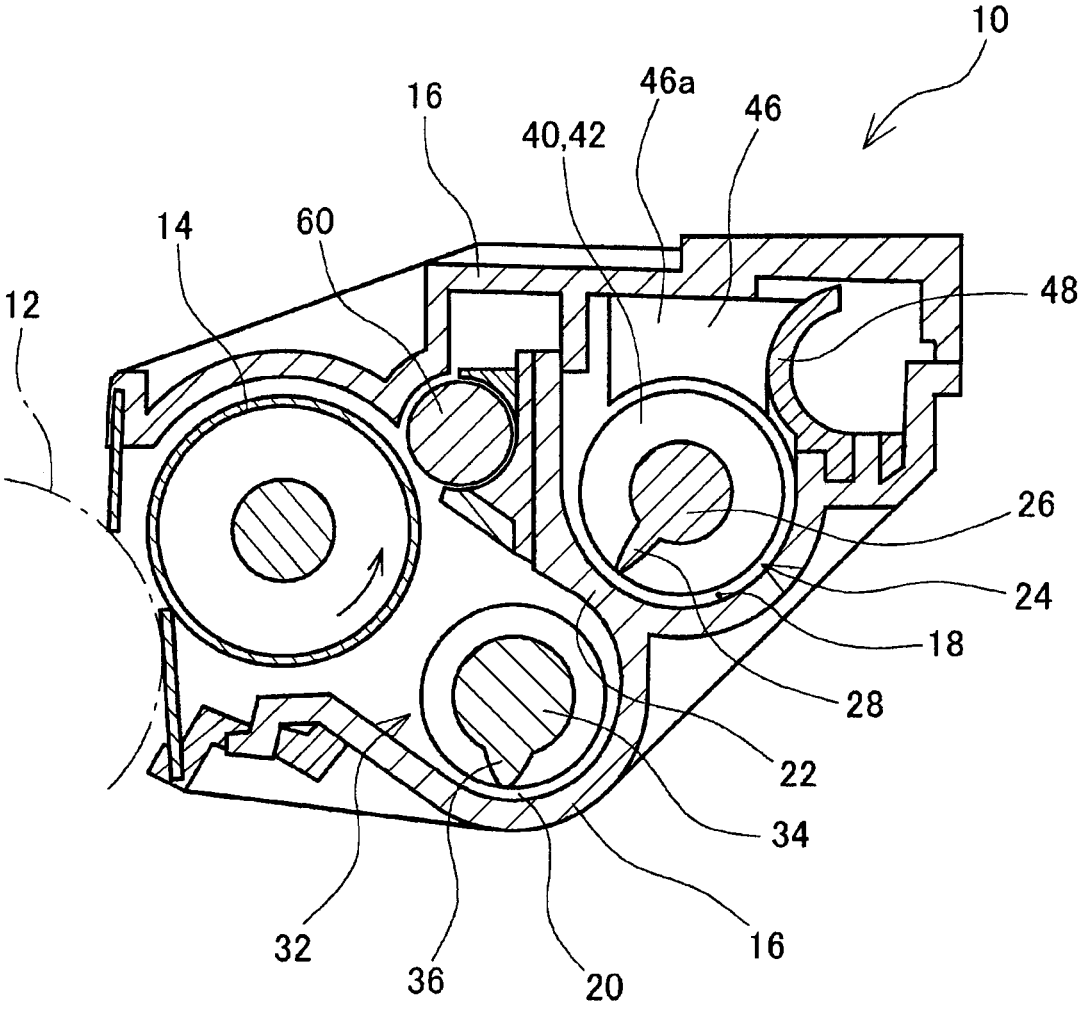
FIG. 1 is a transverse sectional view of a developing device according to an exemplary embodiment.
Figure 2:
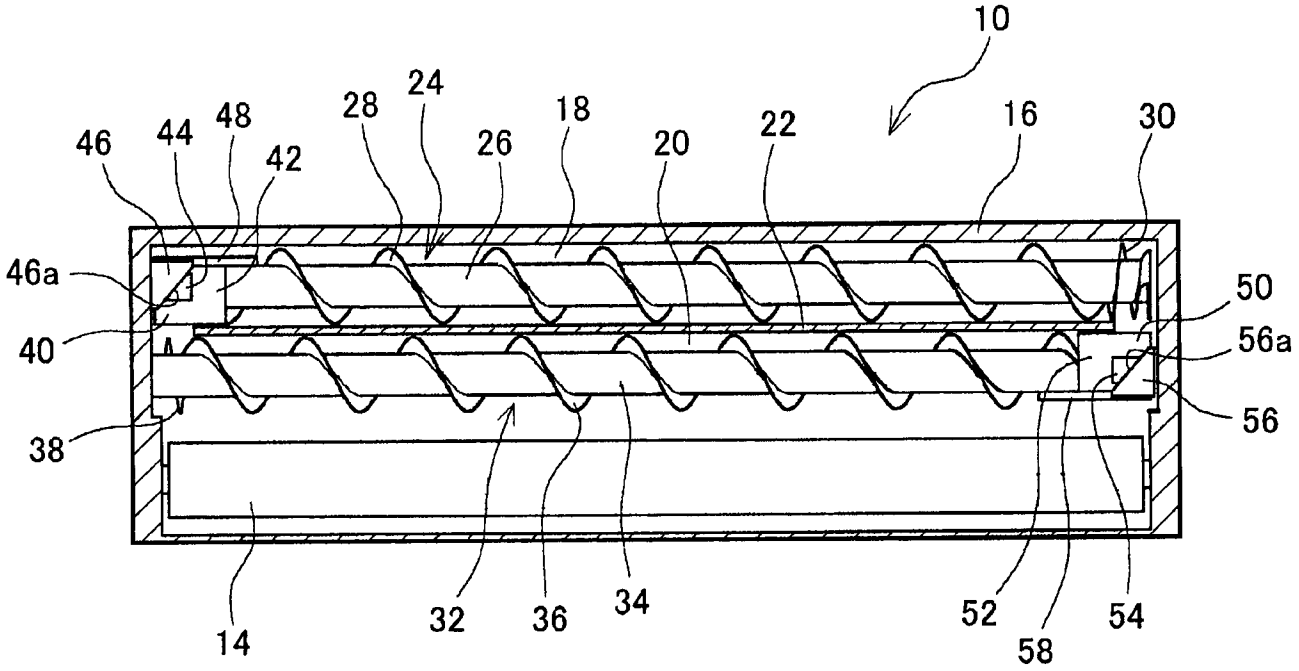
FIG. 2 is a combination sectional view of the developing device according to the exemplary embodiment.

An exemplary embodiment of the present disclosure is described below with reference to the drawings. FIGS. 1 and 2 are sectional views schematically illustrating a general configuration of a developing device 10 of an image forming apparatus. The developing device 10 supplies a toner to a latent image formed on a surface of a photoconductor 12 and thus develops the latent image. The developing device 10 includes a developing roller 14 that is arranged to face the photoconductor 12 and that supplies a toner to the photoconductor 12. A toner image developed on the photoconductor 12 is transferred on a recording medium such as a sheet of paper directly or via an intermediate transfer body.

FIG. 1 is a sectional view of the developing device 10 along a section that is orthogonal to the central axis of the developing roller 14. FIG. 2 is a combination sectional view of the developing device 10 in which some sections including the central axis of the developing roller 14 or parallel to the central axis are combined.

The developing device 10 includes a housing 16 that houses components such as the developing roller 14. In the housing 16, two developer transport paths 18 and 20 are formed. A developer containing a mixture of a toner and a magnetic carrier is transported through the developer transport paths 18 and 20. The two developer transport paths 18 and 20 are arranged adjacently to each other in parallel to each other; and are also parallel to the developing roller 14. In the developing device 10, the two developer transport paths 18 and 20 are arranged at heights that differ from each other. The developer transport path 18 at a higher position is referred to as first developer transport path 18 and the developer transport path 20 at a lower position is referred to as second developer transport path 20.

The first developer transport path 18 and the second developer transport path 20 are separated from each other by a partition wall 22 at a center portion, and communicate with each other at both end portions. In the communication portions, the developer is conveyed from the one developer transport path to the other developer transport path. Thus, a circulation transport path through which the developer circulates is formed.

A first transport screw 24 is arranged in the first developer transport path 18. The first transport screw 24 includes a screw shaft 26 that is a rod-shaped member having a circular section, and a helical blade 28 that is provided to be helically wound around the screw shaft 26. The first transport screw 24 rotates around the central axis thereof and hence the helical blade 28 transports the developer in the first developer transport path 18. The developer in the first developer transport path 18 is transported rightward in FIG. 2. A reverse helical blade 30 that is helically wound reversely to the helical blade 28 is provided at a downstream end portion of the first transport screw 24. The reverse helical blade 30 sends the developer in a reverse direction, that is, leftward, and hence prevents the developer from being retained at a downstream end portion of the first developer transport path 18.

A second transport screw 32 is arranged in the second developer transport path 20. The second transport screw 32 includes a screw shaft 34 that is a rod-shaped member having a circular section, and a helical blade 36 that is provided to be helically wound around the screw shaft 34. The second transport screw 32 rotates around the central axis thereof and hence the helical blade 36 transports the developer in the second developer transport path 20. The developer in the second developer transport path 20 is transported leftward in FIG. 2. A reverse helical blade 38 that is helically wound reversely to the helical blade 36 is provided at a downstream end portion of the second transport screw 32. The reverse helical blade 38 sends the developer in a reverse direction, that is, rightward, and hence prevents the developer from being retained at a downstream end portion of the second developer transport path 20.

A first magnetic roller 40 and a first columnar body 42 are arranged upstream of the first transport screw 24, that is, on the left side in FIG. 2. The first columnar body 42 is arranged on the side close to the first transport screw 24, and the first magnetic roller 40 is arranged on the side far from the first transport screw 24 continuously to the first columnar body 42. The first magnetic roller 40 and the first columnar body 42 have columnar shapes having diameters larger than the diameter of the screw shaft 26 of the first transport screw 24. The first magnetic roller 40 and the first columnar body 42 may have the same diameter. The first magnetic roller 40 includes a permanent magnet 44 embedded in a peripheral surface thereof or a portion thereof close to the peripheral surface. The permanent magnet 44 may be arranged at one position in the circumferential direction thereof or plural permanent magnets 44 may be arrayed to be spaced apart in the circumferential direction. Alternatively, the permanent magnet 44 may be arranged over the entire circumference of the first magnetic roller 40. The first magnetic roller 40 and the first columnar body 42 may be separately fabricated and then may be joined. Alternatively, the first magnetic roller 40 and the first columnar body 42 may be fabricated by providing a portion with the permanent magnet 44 arranged and a portion without a permanent magnet in the axial direction of a single columnar body. In this case, the portion with the permanent magnet 44 arranged corresponds to the first magnetic roller 40, and the portion without a permanent magnet corresponds to the first columnar body 42.

The first magnetic roller 40 and the first columnar body 42 rotate together with the first transport screw 24, and the permanent magnet 44 turns by the rotation. The turning permanent magnet 44 attracts the developer at the downstream end portion of the second developer transport path 20, and conveys the developer upstream of the first developer transport path 18. Thus, the first magnetic roller 40 functions as a first conveyance roller that attracts the developer at the downstream end portion of the second developer transport path 20 by magnetic force and that conveys the developer to an upper portion located upstream of the first developer transport path 18.

A first scraping wall 46 is arranged above the first magnetic roller 40. The first scraping wall 46 scrapes the developer attracted to a surface of the first magnetic roller 40 and sends the developer to an upstream end portion of the first developer transport path 18. The first scraping wall 46 has a wall surface **46*a* arranged to face the developer that is conveyed by the first magnetic roller 40. The wall surface 46*a* is inclined such that a side edge of the wall surface 46*a* on the side near the first transport screw 24 is located on the rear side of a side edge of the wall surface 46*a* on the opposite side in a rotation direction of the first magnetic roller 40. The inclined wall surface 46*a* of the first scraping wall 46 may be provided over the entire width of the first magnetic roller 40, that is, over the entire length in the axial direction of the first magnetic roller 40. The inclined wall surface 46*a* of the first scraping wall 46 may be arranged at an upstream portion of the first magnetic roller 40, and a wall surface extending in the axial direction may be formed at a downstream portion of the first magnetic roller 40**.

The developer sent by the first scraping wall 46 is guided by a peripheral surface of the first columnar body 42 located adjacently to the first magnetic roller 40, and is directed to the upstream end portion of the first developer transport path 18. Thus, the first columnar body 42 functions as a first guide columnar body a peripheral surface of which receives the developer sent by the first scraping wall 46 and that guides the developer to the upstream end portion of the first developer transport path 18.

The first scraping wall 46 may be arranged so as to send the developer to a top portion of the first columnar body 42, that is, to an area around the highest position of the first columnar body 42. Also, a first guide wall 48 may be provided adjacently to the peripheral surface of the first columnar body 42 to send the developer, which has been sent to the top portion of the first columnar body 42, along the generator of the top portion of the first columnar body 42. The first guide wall 48 may be arranged to extend along the generator of the first columnar body 42. In addition, a portion of the first guide wall 48 corresponding to the first columnar body 42, or the entirety of the first guide wall 48 may be arranged in an inclined state. The direction of the inclination is determined such that the side near the first developer transport path 18 is directed rearward in a rotation direction of the first columnar body 42. The first guide wall 48 may be arranged continuously to the first scraping wall 46. Furthermore, the first guide wall 48 may be formed integrally with the first scraping wall 46.

The partition wall 22 has an edge on the left side in FIG. 2 that is aligned with a downstream edge of the first magnetic roller 40, that is, an edge of the first magnetic roller 40 on the side near the first developer transport path 18.

A second magnetic roller 50 and a second columnar body 52 are arranged upstream of the second transport screw 32, that is, on the right side in FIG. 2. The second columnar body 52 is arranged on the side close to the second transport screw 32, and the second magnetic roller 50 is arranged on the side far from the second transport screw 32 continuously to the second columnar body 52. The second magnetic roller 50 and the second columnar body 52 have columnar shapes having diameters larger than the diameter of the screw shaft 34 of the second transport screw 32. The second magnetic roller 50 and the second columnar body 52 may have the same diameter. The second magnetic roller 50 includes a permanent magnet 54 embedded in a peripheral surface thereof or a portion thereof close to the peripheral surface. The permanent magnet 54 may be arranged at one position in the circumferential direction thereof or plural permanent magnets 54 may be arrayed to be spaced apart in the circumferential direction. Alternatively, the permanent magnet 54 may be arranged over the entire circumference of the second magnetic roller 50. The second magnetic roller 50 and the second columnar body 52 may be separately fabricated and then may be joined. Alternatively, the second magnetic roller 50 and the second columnar body 52 may be fabricated by providing a portion with the permanent magnet 54 arranged and a portion without a permanent magnet in the axial direction of a single columnar body. In this case, the portion with the permanent magnet 54 arranged corresponds to the second magnetic roller 50, and the portion without a permanent magnet corresponds to the second columnar body 52.

The second magnetic roller 50 and the second columnar body 52 rotate together with the second transport screw 32, and the permanent magnet 54 turns by the rotation. The turning permanent magnet 54 attracts the developer at the downstream end portion of the first developer transport path 18, and conveys the developer upstream of the second developer transport path 20. Thus, the second magnetic roller 50 functions as a second conveyance roller that attracts the developer at the downstream end portion of the first developer transport path 18 by magnetic force and that conveys the developer to an upper portion located upstream of the second developer transport path 20.

A second scraping wall 56 is arranged above the second magnetic roller 50. The second scraping wall 56 scrapes the developer attracted to a surface of the second magnetic roller 50 and sends the developer to an upstream end portion of the second developer transport path 20. The second scraping wall 56 has a wall surface 56*a* arranged to face the developer that is conveyed by the second magnetic roller 50. The wall surface 56*a* is inclined such that a side edge of the wall surface 56*a* on the side near the second transport screw 32 is located on the rear side of a side edge of the wall surface 56*a* on the opposite side in a rotation direction of the second magnetic roller 50. The inclined wall surface 56*a* of the second scraping wall 56 may be provided over the entire width of the second magnetic roller 50, that is, over the entire length in the axial direction of the second magnetic roller 50. The inclined wall surface 56*a* of the second scraping wall 56 may be arranged at an upstream portion of the second magnetic roller 50, and a wall surface extending in the axial direction may be formed at a downstream portion of the second magnetic roller 50.

The developer sent by the second scraping wall 56 is guided by a peripheral surface of the second columnar body 52 located adjacently to the second magnetic roller 50, and is directed to the upstream end portion of the second developer transport path 20. Thus, the second columnar body 52 functions as a second guide columnar body a peripheral surface of which receives the developer sent by the second scraping wall 56 and that guides the developer to the upstream end portion of the second developer transport path 20.

The second scraping wall 56 may be arranged so as to send the developer to a top portion of the second columnar body 52, that is, to an area around the highest position of the second columnar body 52. Also, a second guide wall 58 may be provided adjacently to the peripheral surface of the second columnar body 52 to send the developer, which has been sent to the top portion of the second columnar body 52, along the generator of the top portion of the second columnar body 52. The second guide wall 58 may be arranged to extend along the generator of the second columnar body 52. In addition, a portion of the second guide wall 58 corresponding to the second columnar body 52, or the entirety of the second guide wall 58 may be arranged in an inclined state. The direction of the inclination is determined such that the side near the second developer transport path 20 is directed rearward in a rotation direction of the second columnar body 52. The second guide wall 58 may be arranged continuously to the second scraping wall 56. Furthermore, the second guide wall 58 may be formed integrally with the second scraping wall 56.

The partition wall 22 has an edge on the right side in FIG. 2 that is aligned with a downstream edge of the second magnetic roller 50, that is, an edge of the second magnetic roller 50 on the side near the second developer transport path 20.

The developer circulates through the first and second developer transport paths 18 and 20 by the actions of the first and second transport screws 24 and 32 and the first and second magnetic rollers 40 and 50. The developer is sent to the periphery of the developing roller 14 from the second developer transport path 20, and is attracted to the surface of the developing roller 14 by the magnetic force. The attracted developer is sent to a position facing a layer regulating member 60 by the rotation of the developing roller 14. The layer regulating member 60 regulates the thickness of the developer on the developing roller 14 to a predetermined thickness, and the developer is sent to a position facing the photoconductor 12.

Figure 3:
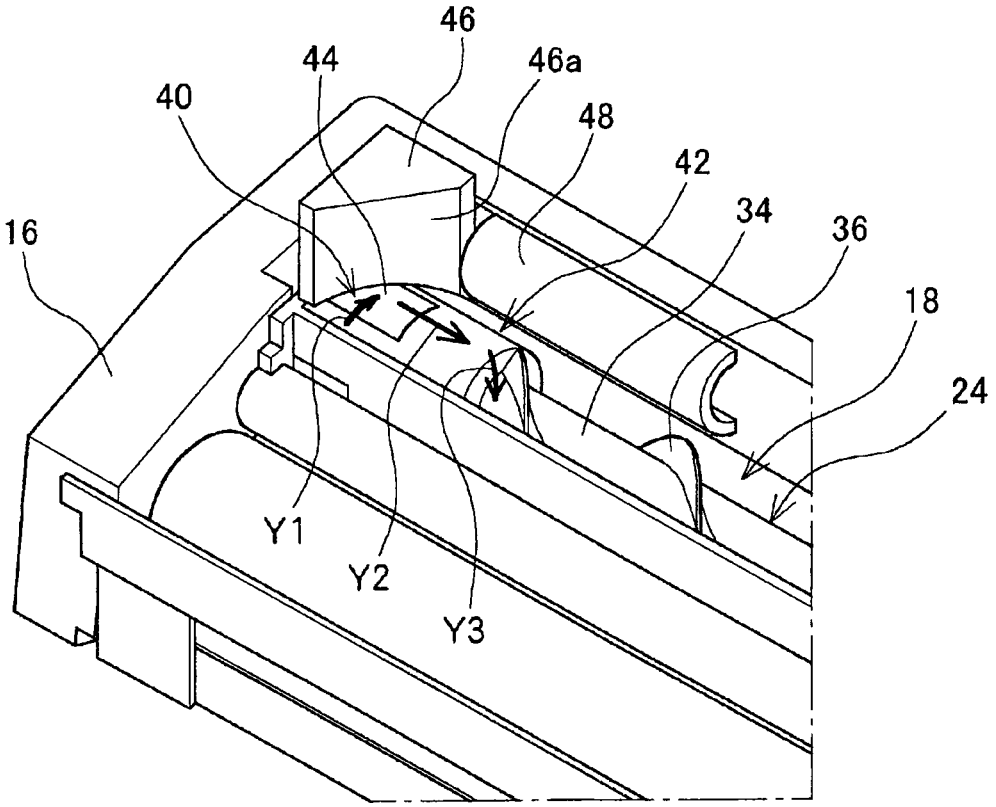
FIG. 3 is a perspective view illustrating a principal portion of the developing device according to the exemplary embodiment.
Figure 4:
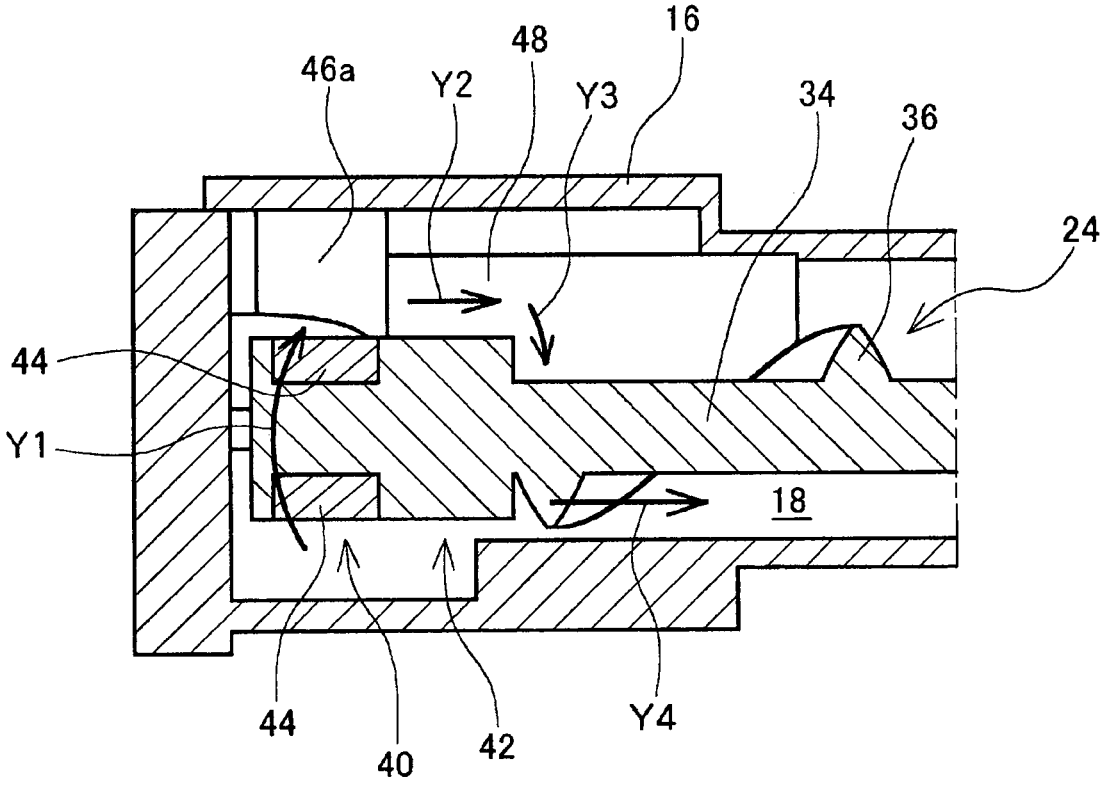
FIG. 4 is a sectional view illustrating a principal portion of the developing device according to the exemplary embodiment.

FIGS. 3 and 4 illustrate end portions of the first and second developer transport paths 18 and 20, and more particularly the periphery of the end portion on the left side in FIG. 2 in an enlarged manner. The developer at the downstream end portion of the second developer transport path 20 is attracted to the permanent magnet 44 of the first magnetic roller 40, and is conveyed to a position above the first magnetic roller 40 by the rotation of the first magnetic roller 40 (arrow Y1). When the developer has reached the first scraping wall 46 located above the first magnetic roller 40, the developer is scraped from the surface of the first magnetic roller 40, and is sent toward the first developer transport path 18 by the inclination of the first scraping wall 46. The sent developer is sent along the peripheral surface of the first columnar body 42 (arrow Y2). At this time, the developer tries to move also in the circumferential direction by the rotation of the first columnar body 42; however, the first guide wall 48 suppresses the movement in the circumferential direction, and the developer is sent in a direction along the generator of the first columnar body 42. In particular, the first scraping wall 46 and the first guide wall 48 may be arranged such that the developer is sent through the top portion of the first columnar body 42.

The developer that has reached an end of the first columnar body 42 on the side near the first developer transport path 18 falls from the end to the first developer transport path 18 (arrow Y3). Then, the developer is transported in the first developer transport path 18 by the first transport screw 24 (arrow Y4).

Since the first columnar body 42 is arranged between the first developer transport path 18 and the first magnetic roller 40, the distance between the developer in the first developer transport path 18, or more particularly, the developer at the upstream end portion thereof and the permanent magnet 44 of the first magnetic roller 40 increases. This prevents the developer located at the upstream end portion of the first developer transport path 18 from being attracted by magnetic force of the permanent magnet 44 and from being retained. In other words, the length of the first columnar body 42 is a length that the developer in the first developer transport path 18 is not attracted to the permanent magnet 44.

Also in the end portions of the first and second developer transport paths 18 and 20 on the right side in FIG. 2, the developer is conveyed from the first developer transport path 18 to the second developer transport path 20 similarly to the left side. Also, when the two developer transport paths are arranged at heights that differ from each other, on the side where the developer is sent from the upper transport path to the lower transport path, the developer is sent by gravitation. If the required flow rate of the developer is ensured by gravitation, the conveyance mechanism of the developer using the magnetic force of the above-described magnetic roller or the like may be omitted.

Figure 5:
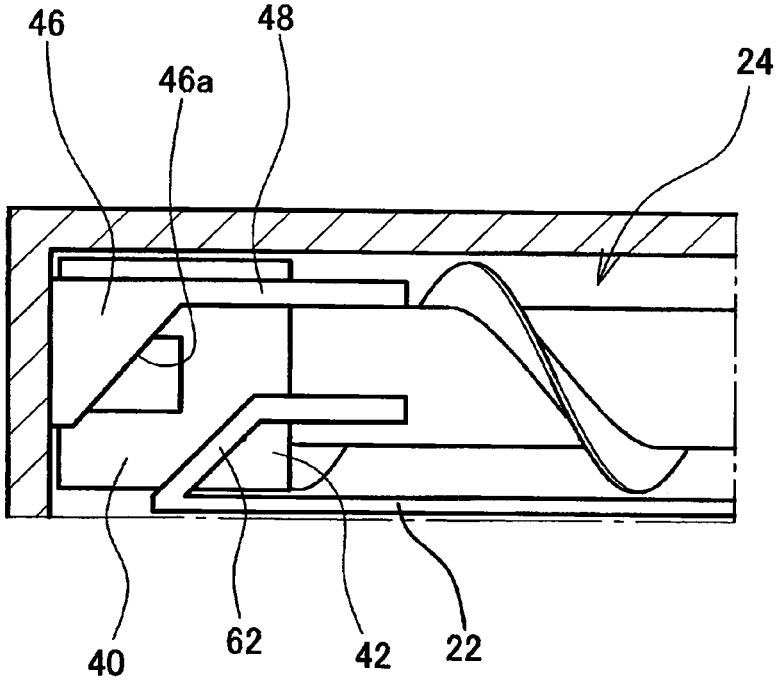
FIG. 5 illustrates a principal portion of a developing device according to another exemplary embodiment.

FIG. 5 illustrates another exemplary embodiment of a mechanism that conveys a developer from one developer transport path to the other developer transport path. The same reference sign is applied to the component that has been described above, and the redundant description is omitted. FIG. 5 exemplarily illustrates the first magnetic roller 40 and its peripheral configuration. In this exemplary embodiment, a counter wall 62 is arranged so as to be adjacent to the peripheral surface of the first columnar body 42 that is arranged adjacently to the first magnetic roller 40 and to face the first guide wall 48. The illustrated counter wall 62 has a bent shape including a portion parallel to the wall surface 46*a* of the first scraping wall 46 and a portion parallel to the first guide wall 48. Without limiting to this, a counter wall may have a straight-line shape parallel to the first guide wall 48. Providing the counter wall 62 limits the width of the path through which the developer is sent. When the developer is pushed from behind, the developer does not slip on and fall from the peripheral surface of the first columnar body 42 and is sent toward the first developer transport path 18. The counter wall 62 may be connected to the partition wall 22 at an end (left end in FIG. 5) of the counter wall 62.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a first developer transport path;

a first transport screw that transports a developer in the first developer transport path;

a first conveyance roller that has a larger radius than a radius of a shaft of the first transport screw, that attracts by magnetic force the developer at a downstream end portion of a second developer transport path arranged next to the first developer transport path, and that conveys the developer to an upper portion located upstream of the first developer transport path;

a first scraping wall that scrapes the developer attracted to the first conveyance roller and that sends the developer; and a first guide columnar body that is adjacent to the first conveyance roller, that has a peripheral surface continuous to a peripheral surface of the first conveyance roller, that receives, using the peripheral surface thereof, the developer sent by the first scraping wall, that guides the developer to an upstream end portion of the first developer transport path, and that has a length that the developer located at the upstream end portion of the first developer transport path is not attracted by the magnetic force of the first conveyance roller.

2. The developing device according to claim 1, wherein the first scraping wall sends the developer to a top portion of the first guide columnar body, and wherein the developing device further comprises a first guide wall that is arranged adjacently to the peripheral surface of the first guide columnar body and that sends the developer along a generator of the top portion of the first guide columnar body.

3. The developing device according to claim 2, wherein guide columnar body is formed integrally with the first conveyance roller.

4. The developing device according to claim 3, wherein the first scraping wall is arranged at least over an entire width of the first conveyance roller.

5. The developing device according to claim 2, further comprising a counter wall that is arranged above the first guide columnar body adjacently to the peripheral surface of the first guide columnar body and that faces the first guide wall.

6. The developing device according to claim 3, further comprising a counter wall that is arranged above the first guide columnar body adjacently to the peripheral surface of the first guide columnar body and that faces the first guide wall.

7. The developing device according to claim 1, further comprising:

a partition wall that separates the first developer transport path and the second developer transport path from each other, wherein an edge of the partition wall is aligned with a downstream end surface of the first conveyance roller.

8. The developing device according to claim 2, further comprising:

a partition wall that separates the first developer transport path and the second developer transport path from each other, wherein an edge of the partition wall is aligned with a downstream end surface of the first conveyance roller.

9. The developing device according to claim 1, further comprising:

a second transport screw that transports the developer in the second developer transport path;

a second conveyance roller that has a larger radius than a radius of a shaft of the second transport screw, that attracts by magnetic force the developer at a downstream end portion of the first developer transport path, and that conveys the developer to an upper portion located upstream of the second developer transport path;

a second scraping wall that scrapes the developer attracted to the second conveyance roller and that sends the developer; and a second guide columnar body that is adjacent to the second conveyance roller, that has a peripheral surface continuous to a peripheral surface of the second conveyance roller, that receives, using the peripheral wall thereof, the developer sent by the second scraping wall, that guides the developer to an upstream end portion of the second developer transport path, and that has a length that the developer located at the upstream end portion of the second developer transport path is not attracted by the magnetic force of the second conveyance roller.

10. A developing device comprising:

a first developer transport path;

a first transport screw that transports a developer in the first developer transport path;

a first magnetic roller that is located upstream of the first transport screw, that is thicker than a shaft of the first transport screw, that rotates together with the first transport screw, and at least a portion of a peripheral surface of which attracts the developer by magnetic force;

a first inclined wall surface that is close to the peripheral surface of the first magnetic roller and that is inclined such that a side edge thereof on a side near the first developer transport path is located on a rear side in a rotation direction of the first magnetic roller;

a first columnar body that is located between the first magnetic roller and the first transport screw, that has a peripheral surface continuous to the peripheral surface of the first magnetic roller, and that has a length that the developer located at an upstream end portion of the first developer transport path is not attracted by the magnetic force of the first magnetic roller; and a first guide wall that is adjacent to the peripheral surface of the first columnar body and that extends along a generator of the first columnar body from the side edge of the first inclined wall surface on the side near the first developer transport path.

11. The developing device according to claim 10, wherein the first inclined wall surface is located above the first magnetic roller.

12. The developing device according to claim 11, wherein the first columnar body is formed integrally with the first magnetic roller.

13. The developing device according to claim 12, wherein the inclined wall surface is arranged at least over an entire width of at least the first magnetic roller.

14. The developing device according to claim 10, further comprising a counter wall that is arranged above the first columnar body adjacently to the peripheral surface of the first columnar body and that faces the first guide wall.

15. The developing device according to claim 11, further comprising a counter wall that is arranged above the first columnar body adjacently to the peripheral surface of the first columnar body and that faces the first guide wall.

16. The developing device according to claim 10, further comprising:

a second developer transport path arranged next to the first developer transport path; and a partition wall that separates the first developer transport path and the second developer transport path from each other, wherein an edge of the partition wall is aligned with a downstream end surface of the first magnetic roller.

17. The developing device according to claim 11, further comprising:

a second developer transport path arranged next to the first developer transport path; and a partition wall that separates the first developer transport path and the second developer transport path from each other, wherein an edge of the partition wall is aligned with a downstream end surface of the first magnetic roller.

18. The developing device according to claim 10, further comprising:

a second developer transport path that is arranged next to the first developer transport path and in which a flow direction of the developer is reverse to a flow direction of the developer in the first developer transport path;

a second transport screw that transports the developer in the second developer transport path;

a second magnetic roller that is located upstream of the second transport screw, that is thicker than a shaft of the second transport screw, that rotates together with the second transport screw, and a peripheral surface of which attracts the developer by magnetic force;

a second inclined wall surface that is close to the peripheral surface of the second magnetic roller and that is inclined such that a side edge of the second inclined wall surface on a side near the second developer transport path is located on a rear side in a rotation direction of the second magnetic roller;

a second columnar body that is located between the second magnetic roller and the second transport screw, that has a peripheral surface continuous to the peripheral surface of the second magnetic roller, and that has a length that the developer located at an upstream end portion of the second developer transport path is not attracted by the magnetic force of the second magnetic roller; and a second guide wall that is adjacent to the peripheral surface of the second columnar body and that extends along a generator of the second columnar body from the side edge of the second inclined wall surface on the side near the second developer transport path.

* * * * *